US006725611B2

(12) United States Patent
DeFiglio

(10) Patent No.: US 6,725,611 B2
(45) Date of Patent: Apr. 27, 2004

(54) SLEEVE HOLDER FOR UTILITY CONDUIT

(76) Inventor: Steven Peter DeFiglio, 569 Grand Oak Dr., West Harrison, IN (US) 47060

( * ) Notice: Subject to any disclaimer, the term of this patent is extended or adjusted under 35 U.S.C. 154(b) by 117 days.

(21) Appl. No.: 09/951,232

(22) Filed: Sep. 13, 2001

(65) Prior Publication Data

US 2003/0047664 A1 Mar. 13, 2003

(51) Int. Cl.[7] ..... E04C 1/00; E04B 1/00

(52) U.S. Cl. ..... 52/99; 52/576; 52/577; 185/3; 185/405

(58) Field of Search ..... 52/99, 699–98, 52/576, 577; 285/189, 4, 3, 192, 18, 196, 45, 215, 56, 216, 405, 217, 387, 421; 249/39; 264/31, 35, 261, 333

(56) References Cited

U.S. PATENT DOCUMENTS

| | | | | |
|---|---|---|---|---|
| 2,694,487 A | | 11/1954 | Christiansen | |
| 3,265,349 A | | 8/1966 | Hamrick | |
| 3,346,230 A | | 10/1967 | Tolf, Jr. | |
| 3,933,336 A | | 1/1976 | Tolf, Jr. | |
| 4,012,874 A | * | 3/1977 | Brogan et al. | 52/99 |
| 4,018,416 A | | 4/1977 | Diener | |
| 4,170,853 A | | 10/1979 | Kohaut | |
| 4,261,598 A | * | 4/1981 | Cornwall | 285/56 |
| 4,342,462 A | | 8/1982 | Carlesimo | |
| 4,365,784 A | | 12/1982 | De Stasio | |
| 4,623,170 A | | 11/1986 | Cornwall | |
| 4,625,940 A | | 12/1986 | Barton | |
| 4,627,647 A | | 12/1986 | Hauff | |
| 4,823,527 A | | 4/1989 | Harbeke | |
| 5,072,911 A | * | 12/1991 | Logsdon | 249/61 |
| 5,156,755 A | | 10/1992 | Cass | |
| 5,293,724 A | | 3/1994 | Cornwall | |
| 5,405,119 A | | 4/1995 | Maguire | |
| 5,431,457 A | | 7/1995 | Youngs | |
| 5,961,155 A | | 10/1999 | Youngs | |

OTHER PUBLICATIONS

Catalog p. 44 showing Pipe Sleeve Clips from Erico Fastening Products–Caddy Fasteners of Solon, Ohio, no date.
Catalog p. 125 showing Pipe Sleeve Fasteners from B–Line Fasteners of Highland, Illinois, no date.
Catalog page (no number) showing zinc concrete slab inserts, elbows and plugs from L.E. Mason Co. of Boston, Massachusetts, no date.
Webpage printout showing concrete pipe sleeves from Arlington industries, Inc., of Scranton, Pennsylvania, Feb. 20, 2000.
Catalog p. EA20 showing Concrete Slab Electroform Insert from O–Z/Gedney of Farmington, Connecticut, no date.
Catalog pp. SA1–SA15 showing Thruwall and Floor Seals from O–Z Gedney of Farmington, Connecticut, no date.

* cited by examiner

*Primary Examiner*—Jeanette E Chapman
(74) *Attorney, Agent, or Firm*—Wood, Herron & Evans, L.L.P.

(57) ABSTRACT

An apparatus for receiving one end of a utility conduit sleeve within a concrete form. The apparatus has a tubular body with an interior surface intersecting first and second ends. The tubular body receives one end of the sleeve through one end and has a flexible flange at its opposite end. The flexible flange is secured against an inside surface of the form. A breakable, thin cover extends over the opposite end of the tubular body to prevent material from entering the tubular body.

22 Claims, 4 Drawing Sheets

SLEEVE HOLDER FOR UTILITY CONDUIT

FIELD OF THE INVENTION

This invention relates to concrete construction and, more particularly, to an improved apparatus for providing a hole through a poured concrete structure.

BACKGROUND OF THE INVENTION

With one type of structural construction, concrete or the like is poured between one or more forms defining various surfaces of the structure. For example, a vertical concrete wall is generally poured between two spaced-apart, vertically arranged forms. Further, in new construction, whether commercial, residential, or industrial, in the formation of concrete walls or the like, it is commonly necessary to provide a relatively large number of accurately located and shaped through-holes or openings to permit various types of utilities to pass through the finished structure, for example, communications and power wiring, plumbing, gas, etc.

It is also desirable to be able to form and maintain such openings through the structure in a relatively simple manner which does not interfere with the formation of the structure. Normally, a plastic or metal sleeve is installed between the forms prior to the pouring of concrete. End flanges or clips at the ends of the sleeve are attached to the concrete forms to preclude movement of the sleeve relative to the forms. In one application, the sleeve has a length equal to the thickness of the wall; and the ends of the sleeve terminate with flanges that are an integral part of the sleeve. The flanges are attached to a concrete form with fasteners such as nails or screws. The fixed, nonflexible flanges are particularly difficult to use when concrete forms are not parallel or have a nonflat surface such as that created by an angled or beveled surface.

In another application, several clips are attached to each end of a straight sleeve in the installation process; and the clips are mounted to the concrete forms with fasteners such as nails or screws. While the clips work reasonably well under ideal conditions, such conditions rarely exist. For example, concrete forms are placed and assembled to rough dimensions and therefore, are not always parallel. With nonparallel forms, it is difficult to initially, properly install the screws holding the clips to the form. Further, if the clips are not properly secured they may become dislodged during the pouring process; and an end of the sleeve is allowed to float in the pour. The end of the sleeve may separate from the form allowing concrete to fill the void between the end of the sleeve and the form and also fill the sleeve. In other situations, the concrete forms may maintain parallelism but lose their verticality. In order to maintain the sleeve generally horizontal, the ends of the sleeve must be mitered at an angle that matches the nonvertical forms. Thus, the installation of the sleeve is more complex and time consuming. In further situations, the clips are difficult to use where the sleeve must be mounted over multiple surfaces of a form, for example, a flat surface and a beveled surface.

Thus, the imprecision and variations in the installation and assembly of the concrete forms and any movement of the forms during the pouring and setting processes often cause significant problems in the installation of sleeves to form through-holes in the walls. Those problems often result in a substantial increase in the time and effort required to install the sleeves and may adversely impact the reliability of the sleeve in forming a through-hole in the wall. Any failure of the sleeve or the attaching clips, requires additional labor to fix any defects in the resulting through-hole. Thus, while a sleeve appears to be a simple device to form a hole in a concrete wall, in practice, there are many conditions that unpredictably add substantial time and cost.

Consequently, there is a need for an improved apparatus for forming through-holes in molded structures such as concrete walls.

SUMMARY OF THE INVENTION

The present invention provides an apparatus for forming through-holes in concrete structures that is simple and quick to install, reliable in use and durable over the useful life of the structure. Using the apparatus of the present invention, through-holes can be formed with a variety of sleeving materials that are commonly found on a construction site. The apparatus of the present invention is especially useful in those applications where sidewalls of the concrete forms are skewed and nonparallel. Thus, the apparatus of the present invention permits through-hole cores to be quickly installed without creating special parts for nonparallel form walls. Further, the apparatus of the present invention is firmly securable on a variety of surfaces and thus, is stable during the pouring and curing process. In addition, the apparatus of the present invention has a knockout end cap that permits conduit, pipes and other utilities to be quickly run.

According to the principles of the present invention and in accordance with the preferred embodiments, the invention provides an apparatus for receiving one end of a utility conduit sleeve within a form. The apparatus has a tubular body with an interior surface intersecting first and second ends. The tubular body receives one end of the sleeve through one end and has a flexible flange at its opposite end. The flexible flange is securable against an inside surface of the form. A breakable, thin cover extends over the opposite end of the tubular body to prevent material from entering the tubular body during a pouring process.

In one aspect of the invention, the tubular body is also made of a flexible material, and the cover is easily breakable or penetrable with a knife or other tool.

These and other objects and advantages of the present invention will become more readily apparent during the following detailed description taken in conjunction with the drawings herein.

DETAILED DESCRIPTION OF THE INVENTION

Figure 1:
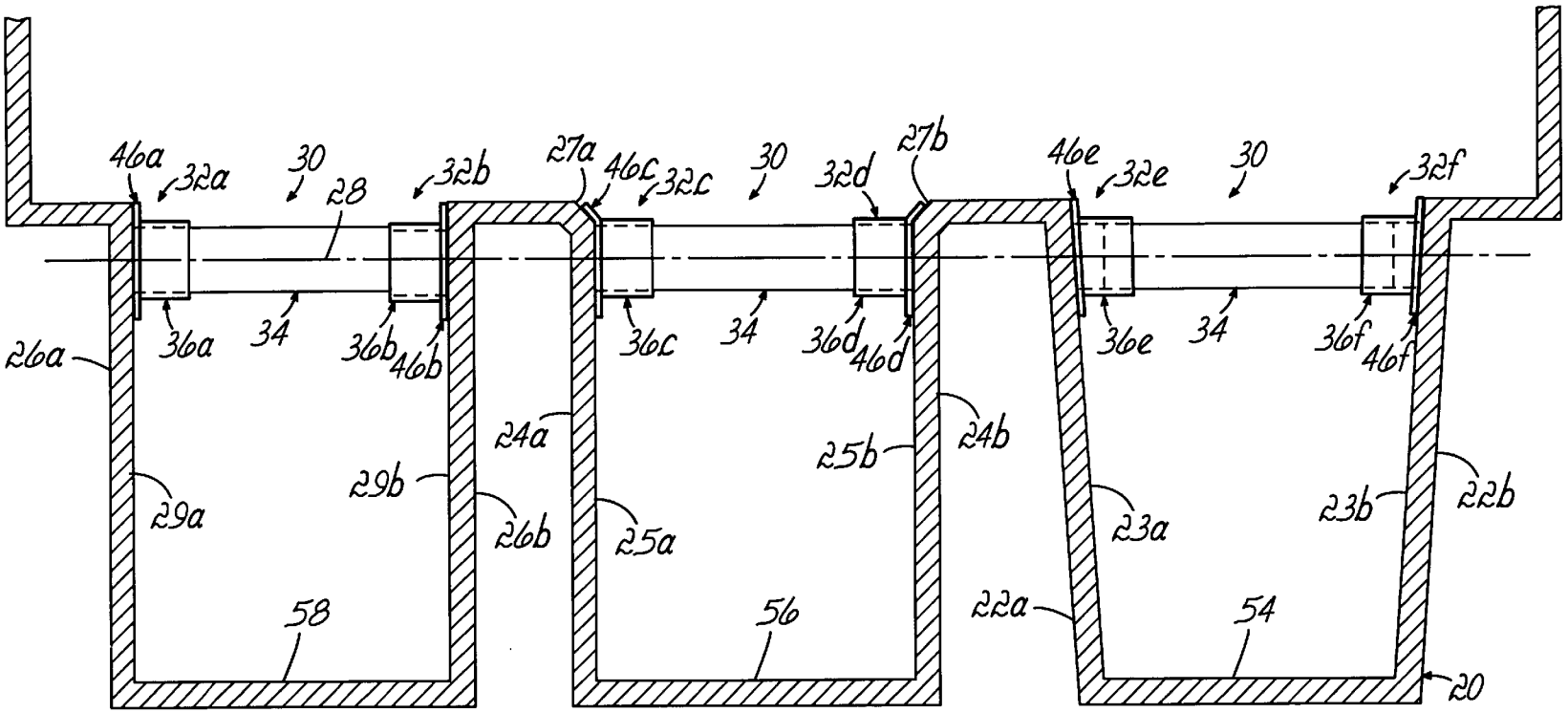
FIG. 1 is a partial cross-sectional view of forms for a molded structure using a sleeve and sleeve holder in accordance with the principles of the present invention.

Referring to FIG. 1, a series of concrete or molded structures are to be created by pouring concrete into a form 20. The form 20 has three sets of opposed sidewalls 22*a*, 22*b*, 24*a*, 24*b* and 26*a*, 26*b*. Further, it is desired to run utilities along a generally horizontal path denoted by the centerline 28. Therefore, it is necessary to form through-holes or openings in the poured concrete that extend between the three pairs of opposed sidewalls 22, 24 and 26, respectively. A core or through-hole forming apparatus 30 is comprised of a pair of flexible sleeve holders 32 and a sleeve 34 that extends therebetween.

Figure 3:
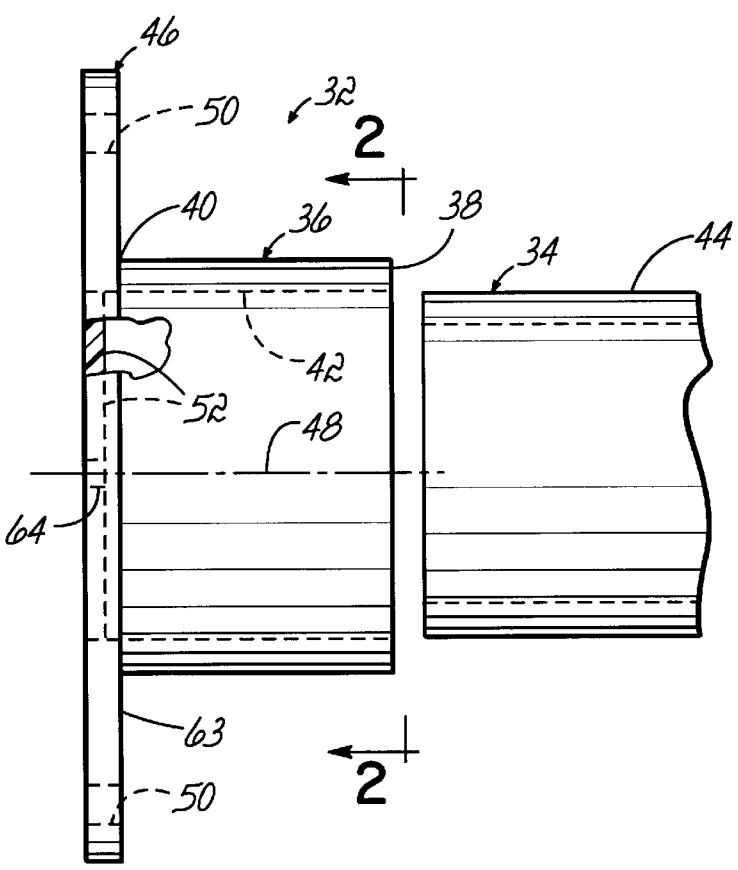
FIG. 3 is a side view of the sleeve holder of FIG. 2.
Figure 2:
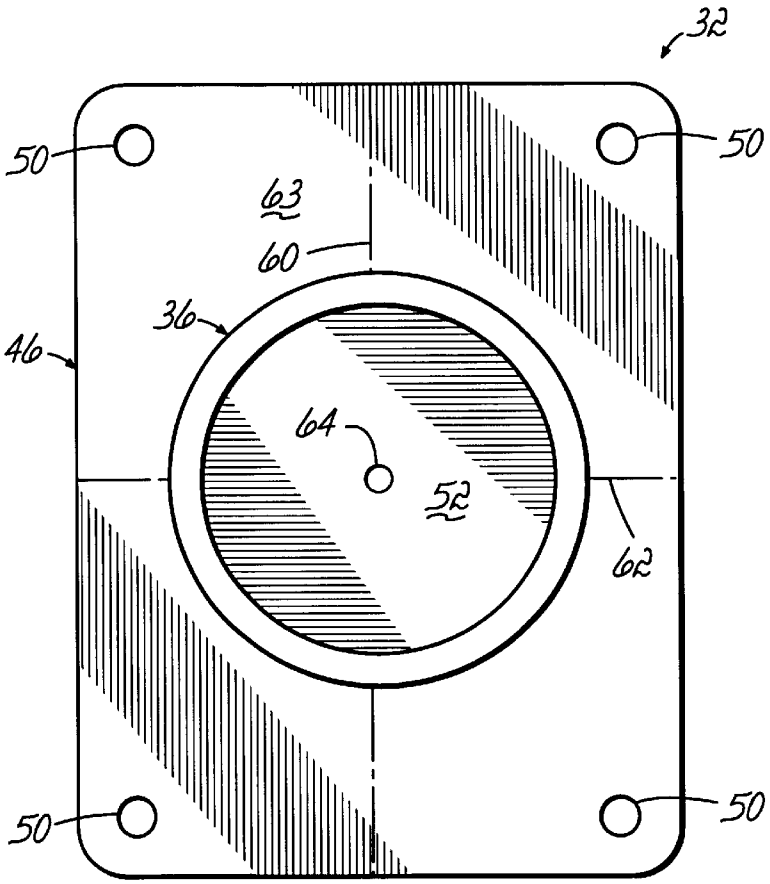
FIG. 2 is an end view of the sleeve holder in accordance with the principles of the present invention.

Referring to FIGS. 2 and 3, the sleeve holder 32 has a tubular body 36 with first and second ends 38, 40, respectively. The tubular body 36 has an interior surface 42 that extends to the first end 38 of the tubular body 36, and the interior surface 42 receives an exterior surface 44 of the sleeve 34. A flexible flange 46 extends from the second, opposite end 40 of the tubular body 36. The flange 46 extends in a direction that is substantially perpendicular to a centerline 48 of the tubular body 36. The flange 46 has a plurality of mounting holes 50 that are used to attach the sleeve holder 32 to inside surfaces 23, 25, 29 of respective sidewalls 22, 24, 26 of the form 20 (FIG. 1). The sleeve holder 32 also has a thin, membrane-like cover 52 that extends over and covers the opposite end 40 of the tubular body 36. The cover 52 functions to prevent material from entering an interior portion of the sleeve holder 32 by passing through its opposite end 40. However, the cover 52 is made to be easily breakable or penetrable with a knife or other tool.

The flexible sleeve holder 32 is normally molded from a plastic material and has a flange thickness and wall thicknesses that provides sufficient strength and durability to withstand use in an environment of poured concrete. However, the flange 46 is made to have sufficient flexibility so as to permit the sleeve holder 32 to conform to nonvertical and nonparallel sidewalls of the form 20. The wall thickness of the tubular body 36 will determine its relative flexibility. For example, when installing the sleeve holders 32 on nonparallel walls, a portion of the tubular body 36 may experience some deformation along with the flange 46. Further, the cover 52 is made so that it is easily broken with a hammer or other tool to open the opposite end 40 of the sleeve holder 32. In addition, the cover 52 is normally brightly colored, so that it is highly visible in the low light environments in which the sleeve holder 32 is often used.

In use, referring to FIG. 1, the sleeve holder 32 is adaptable for use over a wide range of different conditions of the form 20. For example, with some forms, the sidewalls 26*a*, 26*b* have flat interior surfaces 29 upon which the flanges 46 of the sleeve holders 32 are mounted. Further, the sidewalls 26*a*, 26*b* are substantially parallel, so that the centerline 28 of the sleeve 34 is substantially perpendicular to the flange 46. However, if any surface irregularities or chamfers exist, the flexible flange can be deformed over the irregularity or chamber so that the sleeve holder can be firmly attached to the form.

In contrast, with other forms, it may be required that the sleeve holders 32 be mounted over a plurality of different surfaces. The sidewalls 24*a*, 24*b* have respective interior surfaces 25*a*, 25*b* that intersect respective angled surfaces 27*a*, 27*b*. If the flanges 46 are rigid, it would be very difficult to securely fasten the flange 46 to the angled surface 27. However, the flanges 46*c*, 46*d* are sufficiently flexible to allow them to be attached to the respective interior surfaces 25*a*, 25*b* and then bent or folded onto and attached to the respective angled surfaces 27*a*, 27*b*. Thus, the flexible flanges 46*c*, 46*d* lie flat against, and can be easily secured or attached to, the surfaces 25, 27.

The sidewalls 22*a*, 22*b* provide yet another challenge in mounting the sleeve holders 32*e*, 32*f*. In some applications, although it is intended that the sidewalls 22*a*, 22*b* be parallel; they are installed in a nonparallel relationship. In other applications, a purloin is formed in which the spacing at the upper end of the sidewalls 22*a*, 22*b* is greater than the spacing between the sidewalls 24*a*, 24*b*. With some purloin designs, the spacing at the upper end of the sidewalls 22*a*, 22*b* may be twice the spacing at the lower end of the sidewalls 22*a*, 22*b*. Once again, the flanges 46*e*, 46*f* of the sleeve holder 32*e*, 32*f* are attached or mounted securely to the respective interior surfaces 23*a*, 23*b* of the sidewalls 22*a*, 22*b*, respectively. Since the sidewalls 23*a*, 23*b* are not parallel, the centerlines of the sleeve holders 32*e*, 32*f* are not coincident. As will be appreciated, if the sleeve holders 32*e*, 32*f* had a rigid construction, it would be very difficult to mount a sleeve therebetween. However, the flexible nature of the construction of the sleeve holders 32*e*, 32*f* permits the respective tubular bodies 36*e*, 36*f* to deform to a nonperpendicular relationship with respect to the flange 46*a*. Therefore, the tubular bodies 36*e*, 36*f* can readily receive the ends of the sleeve 34 without adversely effecting the attachment of the flanges 46*e*, 46*f* to the respective nonparallel sidewall surfaces 23*a*, 23*b*.

It should also be noted that the nonparallel relationship of the sidewalls 22*a*, 22*b* results in the distance between the sidewalls 22*a*, 22*b* being greater at their upper ends than at their lower ends that are joined to the bottom wall 54. Further, the length of the tubular bodies 36*e*, 36*f* permits a nominal length sleeve 34 to be used. Hence, the sleeves 34 do not have to be measured and cut to a precise length for each application. Further, during the pouring process, the weight of the concrete may cause the forms to expand; and the one of more of the sleeve holders 32 may move with respect to a respective sleeve 34. However, the sleeve 34 remains captive within the tubular bodies 36 of respective sleeve holders 32.

The sidewalls 22, 24, 26 of the form 20 are often assembled together with respective bottom walls 54, 56, 58. Therefore, prior to assembling the form 20, the desired locations of the path 28 and hence, the sleeve holders 32, can be identified on the inner surfaces of the sidewalls 22, 24, 26. The sleeve holders 32 are then mounted thereon using centering score marks 60, 62 (FIG. 2) on the inner surface 63 of the flange 46.

The sleeve holders 32 have other features that facilitate their use. First, the tubular bodies 36 of the sleeve holders 32 are made to have a loose fit with the most common sleeve materials found on a construction site. However, sleeve materials may be used that fit tightly into the tubular bodies 36 of the sleeve holder. To facilitate the assembly of the sleeve holders 32 and a sleeve 34, the cover 52 has one or more vent holes 64 that equalize pressure within the tubular body 36 as it is assembled with a corresponding sleeve 34. In addition, the interior surface 42 may be made or molded from a low friction material and/or coated with a lubricant so that an end of the sleeve 34 is readily, more easily inserted into the tubular body 36.

Figure 5:
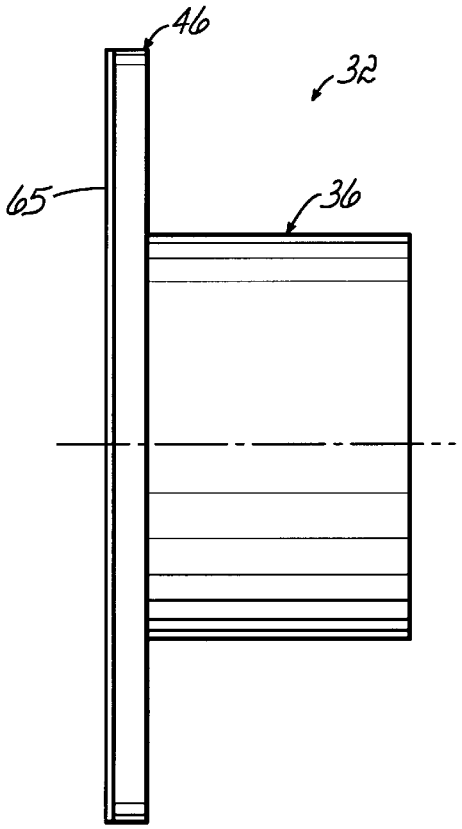
FIG. 5 is a side view illustrating one alternative embodiment of the sleeve holder of FIG. 2.

Referring back to FIG. 1, in one embodiment, after the sleeve holders 32 are mounted on the sidewalls 22, 24, 26, the sidewalls and bottom walls 54, 56, 58 are assembled into the desired form 20. In that process, the sleeves 34 are inserted into the tubular bodies 36 of the respective sleeve holders 32. Alternatively, as will be appreciated, the sleeve holders 32 and sleeves 34 may be assembled at the appropriate locations within a fully assembled form 20. If the form 20 is made of wood or other relatively soft material, the sleeve holders 32 are fastened to the sidewalls 22, 24, 26 using nails, screws or other fasteners that extend through the holes 50 of respective flanges 46. If the form 20 is made of a more durable material, for example, steel, aluminum, fibrous plastic, etc., the sleeve holders 32 are mounted to the sidewalls 22, 24, 26 by bolts or other fasteners extending through the mounting holes 50 of respective flanges 46 and the sidewalls 22, 24, 26 in a known manner. Alternatively, with forms made of a ferrous material, the sleeve holders 32 can be mounted to the inner surfaces of the sidewalls 22, 24, 26 by a magnetic force. A magnetic material can be molded within the flange 46. Alternatively, a magnet 65 (FIG. 5) is located on the flange 46 and contacts the inner surface of the sidewalls 22, 24, 26. The magnet may be adhered to the flange 46 or have pins or projecting stubs that extend through the mounting holes 50 on the flange 46, thereby securing the sleeve holder 32 in its desired location.

Figure 4:
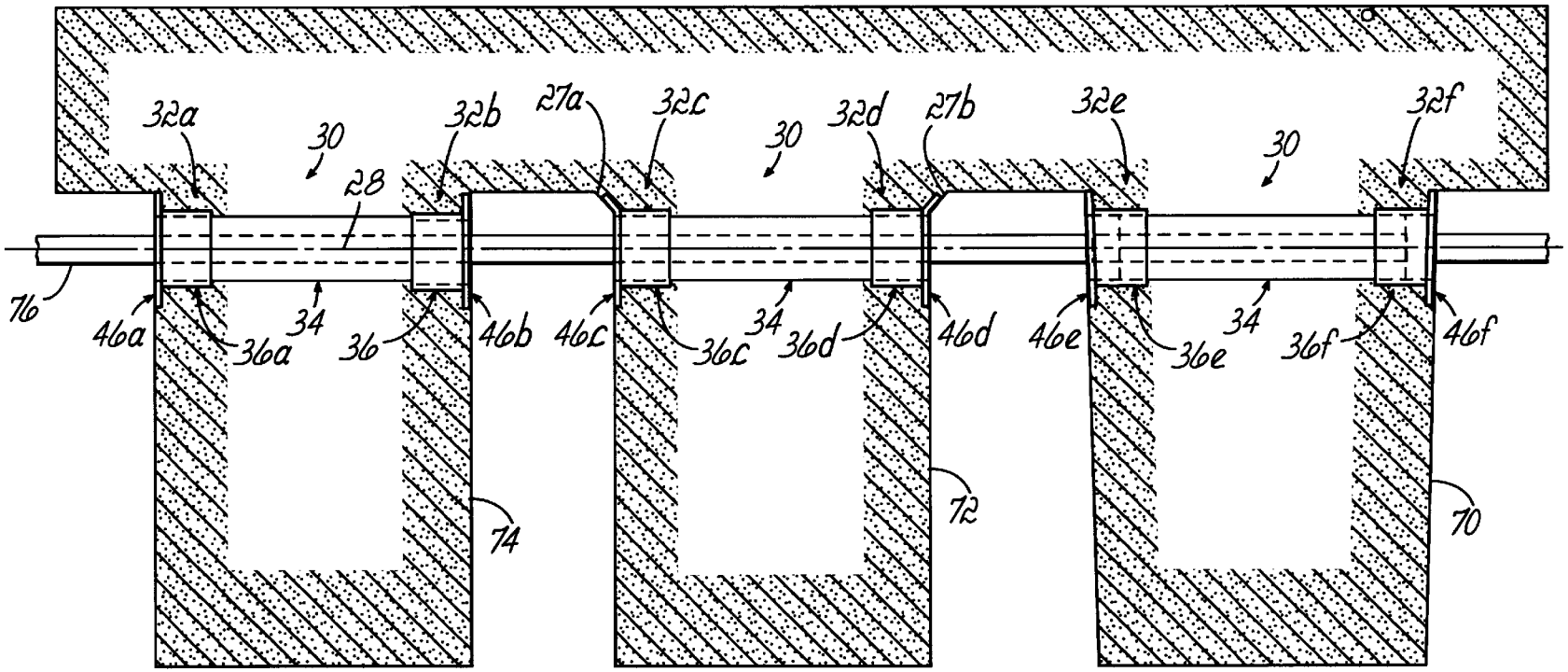
FIG. 4 is a partial cross-sectional view of a molded structure using a sleeve and sleeve holder in accordance with the principles of the present invention.

After the sleeve holders 32 and interconnecting sleeves 34 have been mounted to the sidewalls 22, 24, 26 at various desired locations, concrete is then poured into the form 20. After setting, the form 20 is disassembled, thereby leaving the concrete structure illustrated in FIG. 4. Three concrete structures 70, 72, 74 have been constructed with the hole forming apparatus 30 in each structure. After the form has been removed, the covers 52 (FIG. 2) are knocked out, thereby providing a continuous path or passage 28 through the three structures 70, 72, 74 that permits the running of conduit or pipes 76 therethrough.

The sleeve holders described herein provide an improved structure for forming through-holes in concrete structures. The sleeve holder 32 has a low cost, simple construction, is quick to install, reliable in use and durable over the useful life of the concrete structure. Using the sleeve-holder described herein, through-holes can be formed with a variety of sleeving materials that are commonly found on a construction site, for example, electrical PVC, galvanized rigid conduit, IMC, plumbers DWC, high pressure plastic, cast iron, stainless steel or cold rolled steel, etc. The sleeve holder 32 is especially useful in those applications where sidewalls of the concrete forms have irregular surfaces and/or are skewed and nonparallel. Thus, the flexible sleeve holder 32 permits through-hole cores to be quickly installed without creating special parts for nonparallel form walls. Further, through-hole cores of the present invention are firmly securable on a variety of surfaces and thus, are stable during the pouring and curing process. The sleeve holders 32 do not require additional rebar support that is often used with known through-hole cores to keep them from becoming dislodged during the pouring process or if they are stepped on, etc. In addition, the sleeve holders have knockout end caps that permit conduit, pipes and other utilities to be quickly run.

Figure 6:
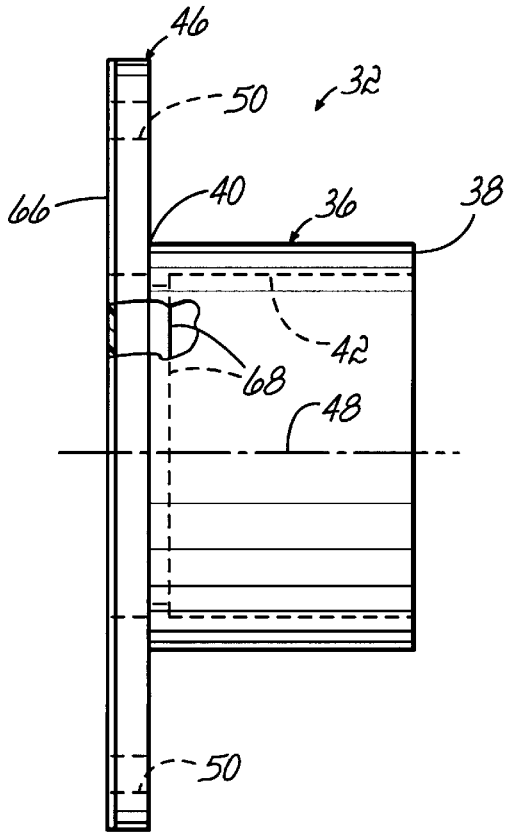
FIG. 6 is a side view illustrating other alternative embodiments of the sleeve holder of FIG. 2.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment of FIGS. 2 and 3, the cover 52 extends across the interior surface 42 within the tubular body 36 and can be molded simultaneously with the molding of the sleeve holder 32. Alternatively, as shown in FIG. 6 a cover 66 is applied to the inner surface 63 of the flange 46 of the sleeve holder. The cover 66 can be applied during or after the molding of the sleeve holder 32. Alternatively, the cover 66 can be a plug that is inserted after the molding process but prior to installing the sleeve holder.

Also, referring to FIG. 6, a rib 68 can be molded on the interior surface 42 of the tubular body 36 of the sleeve holder 32. The rib 68 functions as a positive stop to block a sleeve that is inserted into the tubular body 36. Normally, the rib 68 is a continuous, circular rib extending around the internal surface 42; however, as will be appreciated, the rib 68 can be a discontinuous structure and have many cross-sectional profiles, for example, curvilinear, multilateral, etc. In the described embodiments, a utility path is formed by a tubular sleeve 34 and two flexible sleeve holders 32; however, as will be appreciated, the same path may be formed using the sleeve 34 connected between a flexible sleeve holder 32 and a rigid sleeve holder.

In the described embodiment, only a single size of sleeve holder is illustrated. As will be appreciated, the sleeve holders may be made to accommodate the nominal sizes of a variety of sleeves, for example, 1.25 inches, 1.5 inches, 2 inches, 2.5 inches, 3 inches, 4 inches, 5 inches, etc. The nominal size of the sleeve holder normally is identical to the nominal size of a sleeve that is intended for use with the sleeve holder. Referring to FIG. 2, the flange 46 is illustrated with four mounting holes 50 at its corners. As will be appreciated, as the size of the sleeve holder 32 is increased, a greater number of mounting holes may be used.

Therefore, the invention in its broadest aspects is not limited to the specific details shown and described. Consequently, departures may be made from the details described herein without departing from the spirit and scope of the claims which follow.

What is claimed is:

1. A sleeve holder for receiving one end of a utility conduit sleeve within a concrete form for a concrete structure, the utility conduit sleeve forming an opening in the concrete structure and permitting the passage of conduit and/or pipes through the utility conduit sleeve in the concrete structure, the sleeve holder comprising:

a tubular body comprising first and second ends, an interior surface intersecting the first and second ends of the tubular body and formed to receive an exterior surface at one end of the utility conduit sleeve, and a breakable, thin cover extending over the second end of the tubular body; and a flexible flange extending outward from the second end of the tubular body, the flexible flange being manually deformable and adapted to be placed against an inside surface of the concrete form, the second end of the tubular body forming one end of the opening in the concrete structure and permitting the passage of the conduit and/or pipes through the tubular body in the concrete structure.

2. The apparatus of claim 1 further comprising a ventilation hole in the cover to relieve any partial vacuum that may form within the sleeve.

3. The apparatus of claim 1 wherein the tubular body is flexible.

4. The apparatus of claim 1 wherein the flexible flange extends in a direction substantially perpendicular to a centerline of the tubular body.

5. The apparatus of claim 1 wherein the tubular body is substantially cylindrical.

6. The apparatus of claim 1 wherein the flange is made from a magnetic material.

7. A sleeve holder for receiving one end of a utility conduit sleeve within a concrete form for a concrete structure, the utility conduit sleeve forming an opening in the concrete structure and permitting the passage of conduit and/or pipes through the utility conduit sleeve in the concrete structure, the sleeve holder comprising:

a flexible tubular body comprising
opposed first and second ends, and
a substantially cylindrical interior surface intersecting the first and second ends and formed to receive through the first end an exterior surface of one end of the utility conduit sleeve;

a thin cover extending over and covering substantially all of the second end of the tubular body; and a flexible flange extending outward from the second end of the tubular body in a direction substantially perpendicular to a centerline of the tubular body, the flexible flange being manually deformable and having an outer surface adapted to be placed against an inside surface of a form, the second end of the tubular body forming one end of the opening in the concrete structure and permitting the passage of the conduit and/or pipes through the tubular body in the concrete structure.

8. The apparatus of claim 7 wherein the cover is easily breakable or penetrable with a knife or other tool.

9. The apparatus of claim 7 further comprising a ventilation hole in the cover to relieve any partial vacuum that may form within the sleeve.

10. The apparatus of claim 7 wherein the cover intersects and is wholly contained within the cylindrical interior surface.

11. The apparatus of claim 7 wherein the cover extends over the outer surface of the flange.

12. The apparatus of claim 7 further comprising a rib extending around the interior surface of the tubular body and adapted to block an end of a sleeve being inserted into the tubular body.

13. The apparatus of claim 7 further comprising a magnetic material associated with the flange portion and adapted to secure the flange portion to a magnetic surface.

14. The apparatus of claim 7 wherein the tubular body and the flexible flange are molded from a plastic material.

15. The apparatus of claim 14 wherein the cover is molded from the plastic material.

16. The apparatus of claim 7 wherein the flexible flange is multilateral.

17. The apparatus of claim 16 wherein the flexible flange is substantially quadrilateral.

18. The apparatus of claim 17 wherein the flexible flange has a plurality of holes adapted to secure the flexible flange to the form.

19. The apparatus of claim 7 wherein the flexible flange is made from a magnetic material.

20. The apparatus of claim 7 further comprising a magnet disposed adjacent the outer surface of the flange.

21. A sleeve holder for receiving one end of a utility conduit sleeve within a concrete form for a concrete structure, the concrete form having a first surface and a second surface adjacent to, but nonplanar with, the first surface, the sleeve holder comprising:

a tubular body comprising
a first end and a second end, the first end of the tubular body formed to receive one end of the utility conduit sleeve, and
a breakable, thin cover extending over the second end of the tubular body; and a flexible flange extending outward from the opposite end of the tubular body, the flexible flange being manually deformable to permit the flexible flange to lie flat against simultaneously the first surface and the second surface of the concrete form, the tubular body and the utility conduit sleeve forming an opening in the concrete structure to permit the passage of conduit and/or pipes through the tubular body and the utility conduit sleeve.

22. An apparatus extending between opposed walls of a concrete form for forming a through-hole in a poured concrete structure to permit the passage of conduit and/or pipes through the apparatus in the concrete structure, the apparatus comprising:

a sleeve having opposed ends; and two sleeve holders, each sleeve holder comprising
a flexible tubular body having a first end and a second end, the first end of the tubular body receiving one of the opposed ends of the sleeve,
a breakable, thin cover extending over the second end of the tubular body, and
a flexible flange extending outward from the second end of the tubular body, the flexible flange and the flexible tubular body being manually deformable to permit the flexible flange to be mounted on, and lie flat against, one of the walls, the sleeve and the two sleeve holders forming the through-hole in the concrete structure to permit the passage of conduit and/or pipes through the sleeve and the two sleeve holders.

* * * * *